United States Patent [19]

Hecht et al.

[11] Patent Number: 4,674,380

[45] Date of Patent: Jun. 23, 1987

[54] APPARATUS FOR CUTTING RIBBON

[75] Inventors: David Hecht, 14 E. 90th St., New York, N.Y. 10128; Steven F. Schultz, East Hampton, N.Y.

[73] Assignee: David Hecht, New York, N.Y.

[21] Appl. No.: 823,949

[22] Filed: Jan. 29, 1986

[51] Int. Cl.[4] ..... B26D 7/26; B26D 1/03

[52] U.S. Cl. ..... 83/425.2; 83/425.4; 83/433; 83/436; 83/156; 83/371; 83/364

[58] Field of Search ..... 83/425.2, 371, 364, 83/665, 433, 425.4, 436, 156, 368, 922; 271/274; 198/843; 226/190, 191

[56] References Cited

U.S. PATENT DOCUMENTS 3,407,690 10/1968 Stanley ..... 83/371 X
3,699,621 10/1972 Clarke et al. ..... 29/113 R
3,877,119 4/1975 Gierse et al. ..... 83/433 X
4,312,255 1/1982 Holmstrom ..... 83/433 X

*Primary Examiner*—Donald R. Schran
*Attorney, Agent, or Firm*—McAulay, Fields, Fisher Goldstein & Nissen

[57] ABSTRACT

An apparatus for longitudinally cutting a web into a plurality of ribbons has a plurality of blade holders mounted so that the relative spacing as well as the overall lateral position of the blades can be shifted in response to growth, shrinkage, and lateral shifting of webs, while maintaining the blades perpendicular to the direction of travel of the web. The blades are held in holders having the ends interconnected by a parallelogram linkage and clamped to a rigid bar and a flexible extensible rod.

10 Claims, 7 Drawing Figures

FIG.5
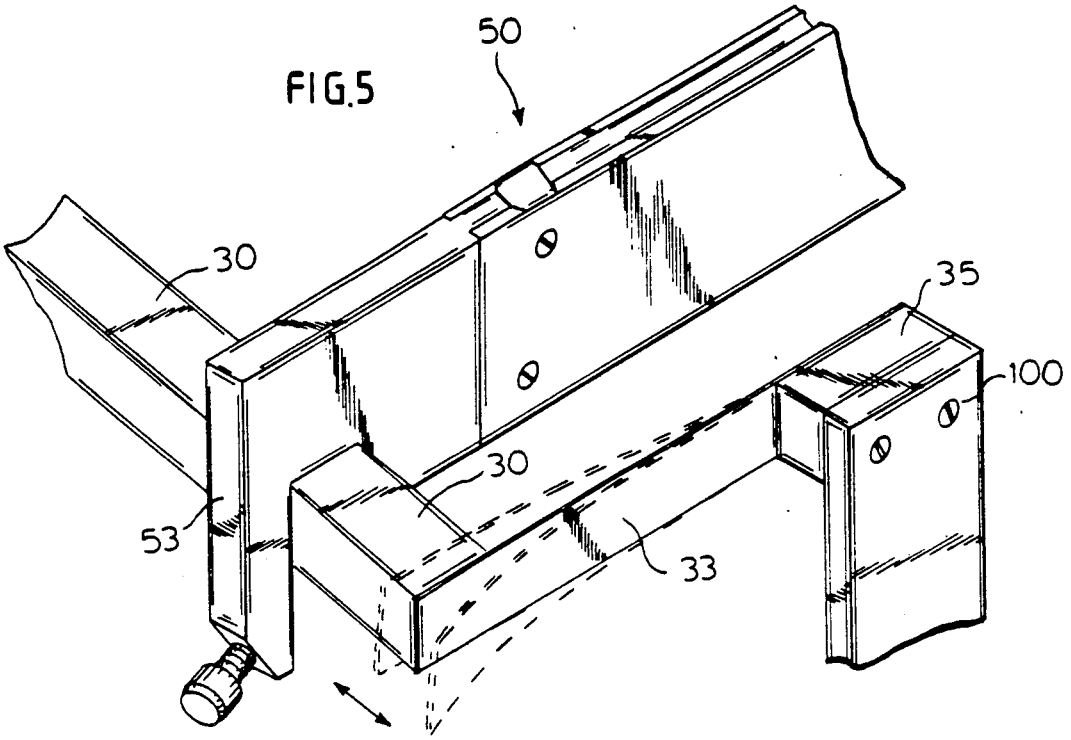
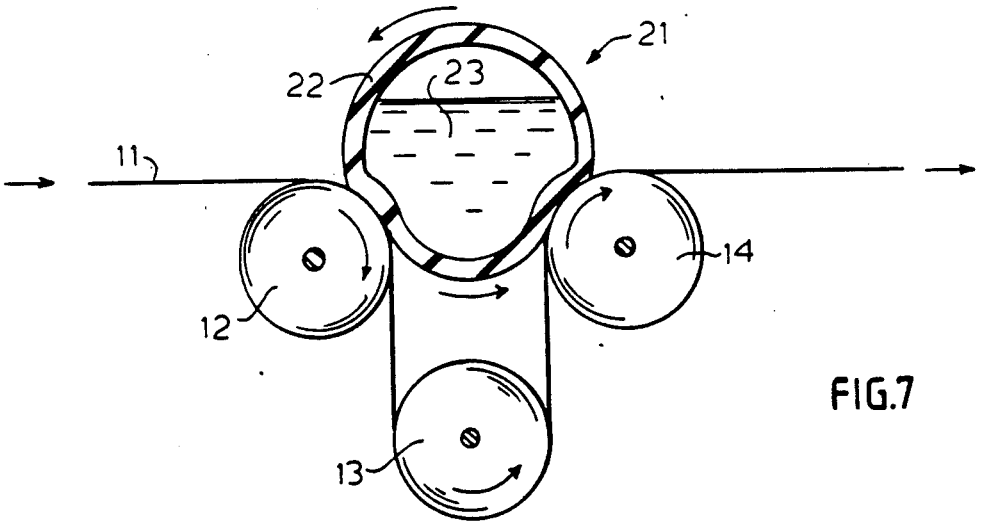
FIG.7

APPARATUS FOR CUTTING RIBBON

BACKGROUND OF THE INVENTION

The present invention relates to apparatus for longitudinally cutting ribbons and the like from webs of material. At present, most ribbons are produced by one of two methods.

In one method, ribbons are cut from webs of material by mounting the rolled web of material on a suitable support roll in a lathe-like machine and rotating the roll. A rotating knife blade is adjusted longitudinally of the web a distance corresponding to the width of the ribbon. The blade is then moved radially inwardly toward the axis of the bolt of material to sever the roll of ribbon from the remainder of the bolt.

However, because of shrinkage, stretching and the lateral shifting of the material as it is wound to form the bolt, it is impossible to align the pattern of each turn of the bolt with the immediately proceding or succeeding turn. Thus, as a result, only webs of random patterns or solid colors are used to produce ribbons by this method.

In the second method, ribbons are cut from fabric by unrolling the web past an array of knives (either stationary or rotary and in some cases heated) whose positions are fixed. The resulting ribbons are then re-rolled at the take-up end of the machine. In this method, as in the first one, due to constant variation in the growth, shrinkage and lateral shifting of the web, no consistent alignment is maintained between the cutting knives and the pattern on the web. Again, only "random pattern" materials are used.

SUMMARY OF THE INVENTION

The main object of the present invention is to provide an apparatus for longitudinally cutting many individual ribbon strips from rolled fabric webs while maintaining straight edges and well aligned patterns in each of the ribbons despite constant variations in the growth, shrinkage and lateral shifting of the web as it is unrolled.

These and other objects are achieved in accordance with the present invention by an apparatus having a plurality of blades each mounted in a flexible blade holder whose front end (nearest to blade) is attached to a nylon rod and whose rear end is mounted on a stiff bar. The stiff mounting bar is supported on a parallelogram linkage which allows it to float in the transverse direction of the web.

The nylon rod is mounted in a configuration which allows it to be stretched and relaxed along its length. Each blade holder consists of two ends (aforementioned) which are in turn interconnected by a spring steel flexure parallelogram linkage which allows the ends to be laterally offset from one another while maintaining their parallel orientation.

The plurality of blades or knives can initially be spaced apart along the bar and rod to obtain the relative spacing therebetween corresponding to the ribbon patterns of the web. Once this is done, the nylon rod is then used to adjust the lateral position and relative spacing of the knives in response to variations in the pattern on the web during unwinding from its supply roll. This is accomplished by two operators who manually control the positions of the two ends of the nylon rod. Each operator concentrates on one knife on his respective side of the web and adjusts the corresponding end of the nylon rod to keep that knife aligned with the proper point on the web pattern. Provided that proper knife alignment is maintained near the two edges of the web, each of the remaining knives will be positioned proportionally by the nylon rod as it is stretched, relaxed and shifted laterally thus resulting in proper alignment of all of the knives with respect to the web pattern.

In another embodiment in accordance with the present invention, near each of the two edges of the web, a line on the web pattern is sensed by a photo-electric device. The output of it controls a servo-positioning mechanism which can adjust the position of the corresponding end of the nylon rod in response to variations in the web pattern.

In another feature of the present invention, the individual strips of ribbon are pulled off downstream of the plurality of knives by a series of drive rollers which employ a flexible fluid-filled rubber roller in conjunction therewith to keep the ribbons in contact with the drive rollers. The rubber roller is filled with a heavy liquid, water for example, which distributes itself uniformly along the inside of the roller, thus providing uniform downward weight pressure and thus uniform driving traction on all of the ribbons.

These and other features and advantages of the present invention will be better understood from the following detailed description of the invention taken in conjunction with the attached drawings, wherein:

BRIEF DESCRIPTION OF THE DRAWING

FIG. 5 is a detailed view of the support for the rear mounting bar for the blade holders;

FIG. 7 is a side sectional view of the drive system for the web in accordance with the present invention.

DETAILED DESCRIPTION OF THE INVENTION

Figure 1:
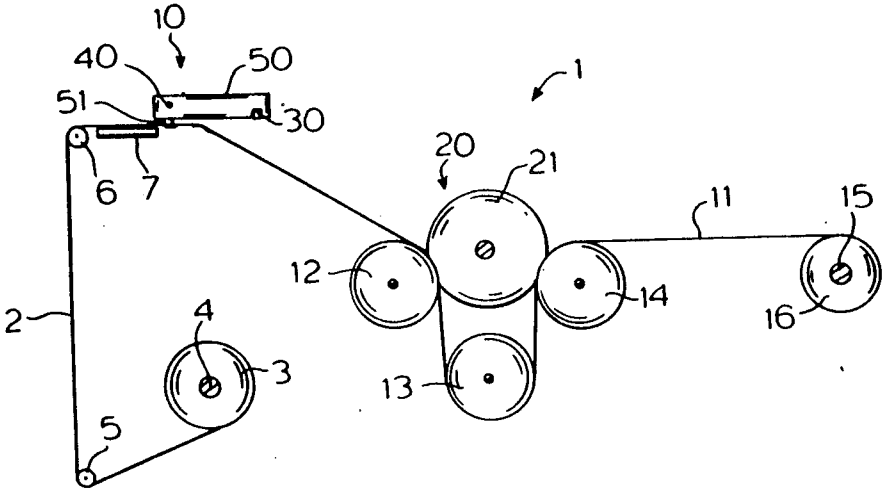
FIG. 1 is a schematic view of the apparatus in accordance with the present invention.

Referring now to FIG. 1, the apparatus 1 in accordance with the present invention comprises a supply spindle 4 which receives a rolled web 3 of fabric which has a plurality of patterns printed or woven thereon. The web 2 is held under tension by spindle 4 and travels around guide rollers 5 and 6 to a cutting station 10 which comprises a cutting support of platen 7 which extends the entire width of the web 2 and a plurality of blade holders 50 each of which have a blade 51 held therein and each mounted at the two ends by mounting bar 30 and nylon rod 40. After cutting the web 2 into a plurality of individual strips 11 by the blades 51, the strips 11 are taken off through a drive mechanism 20 including three driven rollers 12, 13 and 14 and a flexible pressure roller 21 which will be described hereinafter. The driven strips 11 are then taken off onto roller 15 to form individual rolls 16 or the strips 11 can be taken off for additional processing.

Figure 2:
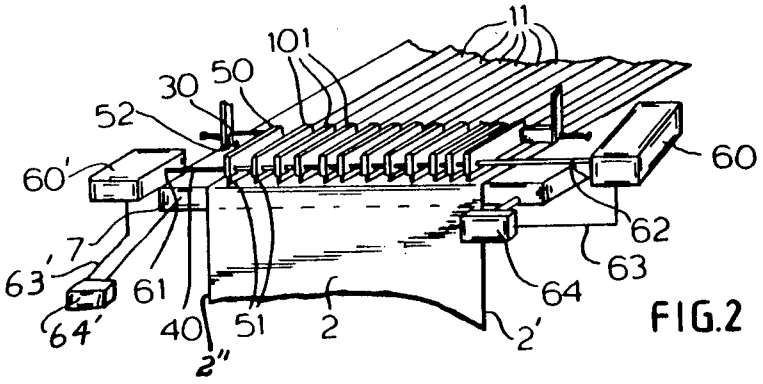
FIG. 2 is a frontal perspective view of the blades mounted in accordance with the present invention.

FIG. 2 shows the cutting station 10 in more detail. As shwon, the web 2, which is under tension, is driven through the cutting station so as to be split up into individual strips 11. This is carried out by a plurality of blades 51 each of which is mounted in a blade holder 50.

The blade holders 50 have a front end through which a nylon rod 40 extends and to which each blade holder 50 is rigidly connected. The other end of each blade holder 50 is connected to a rigid mounting bar 30. The two ends of each blade holder 50 are interconnected by a spring steel parallelogram linkage 52 which will be described in more detail with reference to FIGS. 3 and 4.

The ends of bar 30 are connected to flexible spring steel plates to allow a shifting thereof to the right or left as will be explained in more detail with reference to FIGS. 5 and 6.

As a result of the mounting of the blades 51 and the blade holders 50 as hereinbefore described, the blades 51 are able to follow the pattern of the fabric web 2 even if there is a lateral shifting thereof as it unwinds from roll 3. As a result, ribbons having substantially straight edges may be produced with a uniform pattern thereon.

In the simplest embodiment in accordance with the present invention, the shifting of the righthand blade to follow the lateral shifting of a pattern near edge 2' of the web 2 can be carried out by an operator stationed at the right side of the apparatus and manually moving the right side of rod 40 to keep it aligned with the movement of a pattern near edge 2' and similarly the shifting of the lefthand blade to follow the lateral shifting of a pattern near edge 2'' of the web 2 can be carried out by an operator stationed at the left side of the apparatus and manually moving the left side of rod 40 to keep it aligned with the movement of a pattern near edge 2''. Thus, each operator by following his own pattern at each side will compensate for the stretching, shrinkage and lateral displacement of the patterns on the web and by such action will proportionately distribute the cut to all the blades in between.

In a particular preferably commercial embodiment of the present invention, optoelectric means 64 and 64' are provided which sense the position of a pattern near edge 2' and a pattern near edge 2'' respectively, during the moving of the web through the cutting station 10. In response to sensing movement either to the left or the right, the output of the optoelectric sensors 64 and 64' are fed via lines 63 and 63' to servo mechanisms 60, 60' respectively which effect the movement and stretching or releasing of the rod 40 to the left and right consistent with the movement of the patterns near edge 2' and 2''. The mechanisms 60, 60' are connected to ends of rod 40 by connecting members 61, 62.

Figure 4:
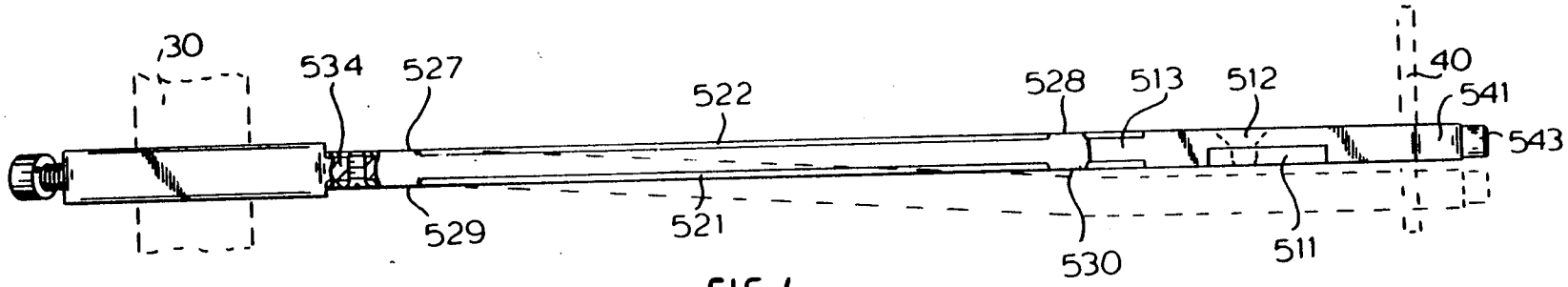
FIG. 4 is a top view of the blade holder of FIG. 3.
Figure 3:
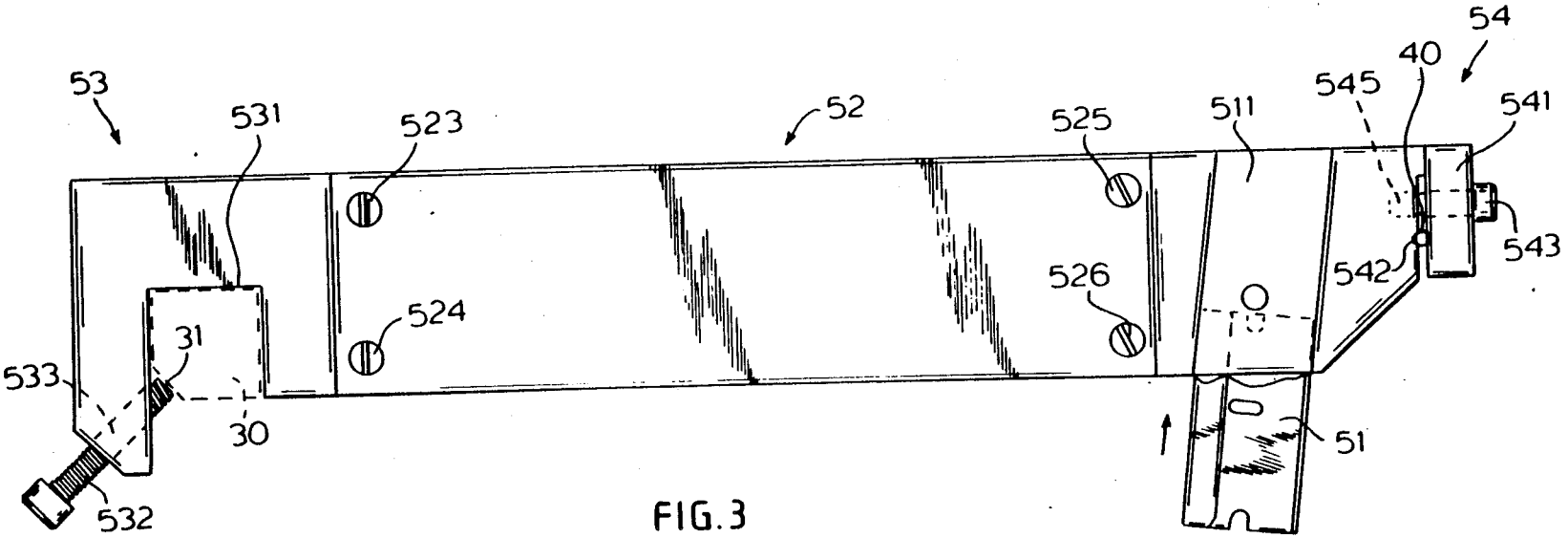
FIG. 3 is a side view of the blade holder in accordance with the present invention.

FIGS. 3 and 4 show the blade holder 50 in accordance with the present invention. The blade holding end 54 of the blade holder 50 has a cutout 511 for receiving a blade 51 as shown. The blade is held in place by means of a mounting screw 512. End 54 also includes a clamping mechanism for rigidly connecting the end 54 to the nylon rod 40. The clamping mechanism includes clamping member 541 which is opposite a depression 542 which receives nylon rod 40 therein. The clamping member 541 is clamped against the rod 40 by means of screw 543 which is engaged in the threaded hole 545.

The other end 53 of the blade holder has a cutout 531 for receiving mounting bar 30 therein with a flattened edge 31 thereof in the position shown. End 53 includes a clamping mechanism for rigidly connecting the end 53 to the bar 30 and this clamping mechanism includes the clamping screw 532 which is received through threaded hole 533 and which is rotated until the end of the screw contacts the flattened surface 31 of bar 30.

The parallelogram linkage 52 comprises two flexure plates 521, 522 which are composed of spring tempered steel and are preferably 0.05" thick. The plates 521, 522 have flexure hinges comprising thin sections 527–530 therein which have a thickness of approximately 0.01". The plates 521, 522 are connected to the ends 53, 54 at portions 534 and 513 respectively by means of connecting screws 523–526.

As shown in FIG. 4, the dotted lines show the typical offset position that can be achieved by the parallelogram linkage and this is characteristically approximately plus or minus 5/16". Whatever the degree the effort is, however, the knife blade remains parallel to its normal position.

Figure 6:
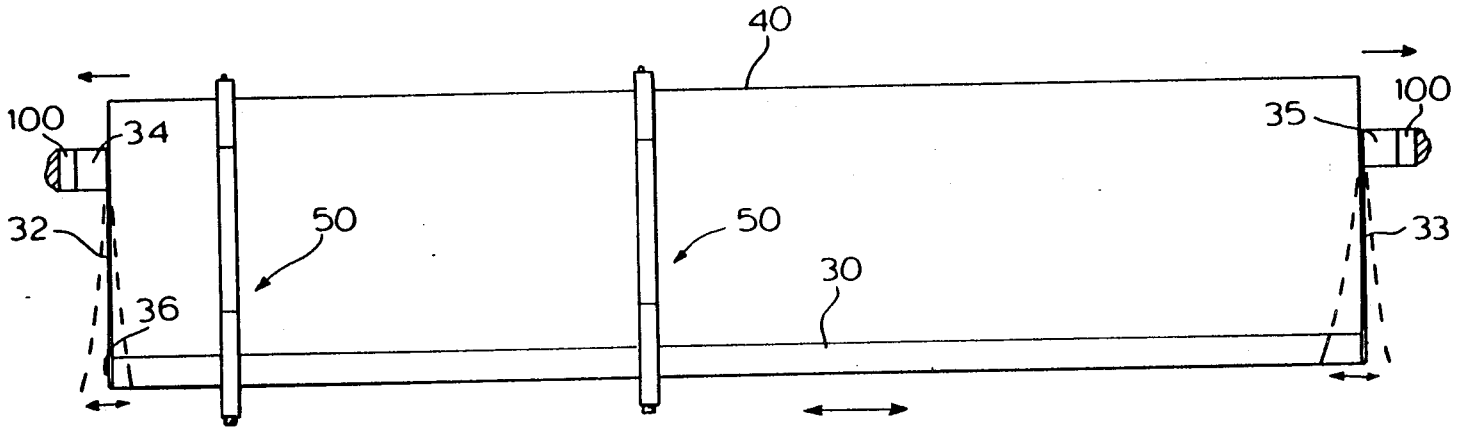
FIG. 6 is a top view of the mounting of the blade holders in accordance with the invention.

Referring now to FIGS. 5 and 6, the parallelogram linkage which supports the mounting bar 30 is shown in more detail. As shown, mounting bar 30 is capable of shifting from the left to the right by means of the linkage including flexible spring steel plates 32, 33 connected at either end thereof. These plates 32, 33 are connected to mounting blocks 34, 35 which are in turn connected to mounting tabs 100 from the machine frame.

This mounting configuration supports the mounting bar such that it is well constrained in all axes (rotational and translational) except for translation along its length (transverse motion with respect to the web).

The parallelogram linkage is constructed such that it's spring constant is much less than that of the combined spring constant of a number of knife holders (e.g. 5 holders or more). This means that in the configuration of FIGS. 5 and 6, if the nylon rod is pulled to one side, the knife holder parallelograms will deflect very little but the mounting bar linkage will deflect a great deal.

In its rest position, the mounting bar 30 is centered within the machine frame and it is in this position when the knife holders are initially fastened to it. This is, the blade holders 50 are unclamped at ends 53 and 54 and placed at desired spaced apart positions corresponding to the pattern on the web to be cut. The clamping screws 532 and 543 are then tightened to fix the holders in place on bar 30 and rod 40. As the web is unwound and carried past the cutting knives, the position of the nylon rod 40 (and therefore the knives) is adjusted in response to variation in the pattern on the web. If the web is simply translated left or right, the mounting bar will shift accordingly on its parallelogram thus requiring no deflection in the knife holder parallelograms. If, however, the nylon rod is simply stretched or relaxed with no net left/right translational offset, the mounting bar linkage will remain in its rest position but the knife holder linkages will deflect in varying amounts to follow the nylon rod position. Subsequently, in cases where both growth (or shrinkage) and translation are required, the knife holder linkages will accommodate the growth/shrinkage and the mounting bar linkage will accommodate the translational offset.

This separation of growth/shrinkage v. lateral translation, is important since the physical characteristics of the knife holders limits them to small offset changes (approximately ±5/16").

FIG. 7 shows the drive system 20 for the web material and includes the three driven rollers 12–14 with arrows thereon showing the sense of rotation of each. In accordance with the present invention, the web 11 is held in contact with the driven rollers 12 and 14 by means of a flexible roller 21 which comprises flexible rubber tubing 22 which is filled with a liquid 23 which is preferably water. The ends of the tube 22 are sealed and the tube 22 is allowed to rest against the rollers 12 and 14 with the web 11 therebetween.

Due to the flexibility of the rubber tube and the ability of the fluid to evenly distribute itself inside the tube (assuming the central axis of the tube is level) uniform pinching force is developed along the entire width of the web despite surface variation in the drive rollers or deflection of same due to web tension.

Another feature of the drive system of FIG. 7 is the tension amplification afforded by the "windlass effect" resulting from the appropriate positioning of the three drive rollers. Although the flexible roller provides very uniform pinching force, the magnitude of this force is not great enough for most practical applications. However, the relatively weak but uniform, pinch force developed at roller 14, is amplified by the contact angle of the web with rollers 12 and 13 (i.e., a small traction force at roller 14 results in a proportional traction force of much greater magnitude at rollers 12 and 13).

It will be appreciated that the instant specification and claims are set forth by way of illustration and not limitation, and that various modifications and changes may be made without departing from the spirit and scope of the present invention.

What is claimed is:

1. An apparatus for cutting a web into strips of ribbon, comprising: means for driving a web through the apparatus along a direction of travel; means upstream of the driving means for longitudinally cutting the driven web into a plurality of strips comprising respective blade holding means for holding a plurality of blades parallel to the direction of travel and means for laterally shifting the respective blade holding means and changing the blade spacing in response to variations in the patterns of the web while maintaining the blades parallel to the direction of travel, said lateral shifting means including a flexible and resilient rod interconnecting each of said blade holding means adjacent the associated blade.

2. The apparatus according to claim 1, wherein each blade holding means comprises a first and a second end portion and parallelogram linking means interconnecting the two end portions to enable the lateral shifting of the first end portion relative to the second end portion while maintaining the blade parallel to the direction of travel, and wherein the lateral shifting means comprises a mounting bar rigidly connecting the second end portions of the blade holding means, and a flexible rod interconnecting the first end portions of the blade holding means.

3. The apparatus according to claim 2, wherein the linking means for each holder comprises two spaced apart spring steel plates with flexure hinges at the connection to the end portions.

4. The apparatus according to claim 2, wherein the lateral shifting means further comprises a parallelogram mount for said mounting bar, whereby the need for individual knife holder linkages to deflect in response to pure lateral translation of the web is eliminated.

5. The apparatus according to claim 2, wherein the end portions includes means for releasably clamping same to the bar and rod.

6. the apparatus according to claim 1, wherein the means for driving comprises at least three driven rollers, and a pressure roller for forcing the web into contact with two of the driver rollers, the pressure roller comprising a flexible tube filled with liquid.

7. The apparatus according to claim 2, wherein the lateral shifting means comprises an optoelectric sensor for sensing the position of one feature of the pattern near one edge and another optoelectric sensor for sensing the position of another feature of the pattern near the opposite edge of the web and servo means connected to each end of the rod for shifting same in response to the output of the sensors.

8. The apparatus according to claim 2, wherein the lateral shifting means comprises sensors for sensing the respective lateral positions of longitudinally oriented patterns across the face of the web, and servo means connected to each respective end of the rod for shifting same in response to the output of the sensors.

9. The apparatus according to claim 3, in which said spaced apart spring steel plates of each holder have a first spring constant, and said lateral shifting means further comprises a parallelogram mount including two spaced apart spring steel plates each connected to an end of said bar and having a second spring constant that is less than the combined spring constant of a plurality of said holders.

10. An apparatus for cutting a web into strips of ribbon, comprising: means for longitudinally cutting a web into a plurality of strips; and means downstream of the cutting means for driving the web through the cutting means along a direction of travel, comprising driven rollers and a pressure roller for forcing the web into highly uniform contact with the (driven) rollers, the pressure roller comprising a flexible tube filled with liquid, said pressure roller being suspended above and positioned between and in contact with at least two driven rollers and adapted to receive the strips at the point of contact between said pressure roller and said driven rollers, whereby the weight of the liquid in said pressure roller forces the strips into intimate contact with the driven roller.

* * * * *